United States Patent [19]

Peterson

[11] 4,235,169

[45] Nov. 25, 1980

[54] DOOR LOCKING MECHANISM FOR SIDE DUMP RAILWAY HOPPER CARS

[75] Inventor: William H. Peterson, Homewood, Ill.

[73] Assignee: Pullman Incorporated, Chicago, Ill.

[21] Appl. No.: 923,130

[22] Filed: Jul. 10, 1978

[51] Int. Cl.[3] ..... B61F 9/00

[52] U.S. Cl. ..... 105/251; 105/240; 105/290; 105/286; 105/308 R

[58] Field of Search ..... 105/251, 241.1, 240, 105/239, 247, 280, 286, 288, 308 R

[56] References Cited

U.S. PATENT DOCUMENTS

| | | | |
|---|---|---|---|
| 1,160,828 | 11/1915 | Blest | 105/251 |
| 3,675,590 | 7/1972 | Schuller | 105/251 |

*Primary Examiner*—Richard A. Bertsch
*Attorney, Agent, or Firm*—Richard J. Myers

[57] ABSTRACT

An open top hopper car particularly adapted to transport logs and pulpwood products includes a car body having a central partition separating the car into a pair of hoppers which are open at their lower ends for discharging materials sideways and downwardly through the supporting track into a pit area. The car is provided with a door locking mechanism including a longitudinally extending actuating member which by means of flexible linkages rotates bellcranks supported on a hopper out of locking engagement with keeper members provided at the lower ends of a pair of swinging doors.

14 Claims, 8 Drawing Figures

FIG. 3
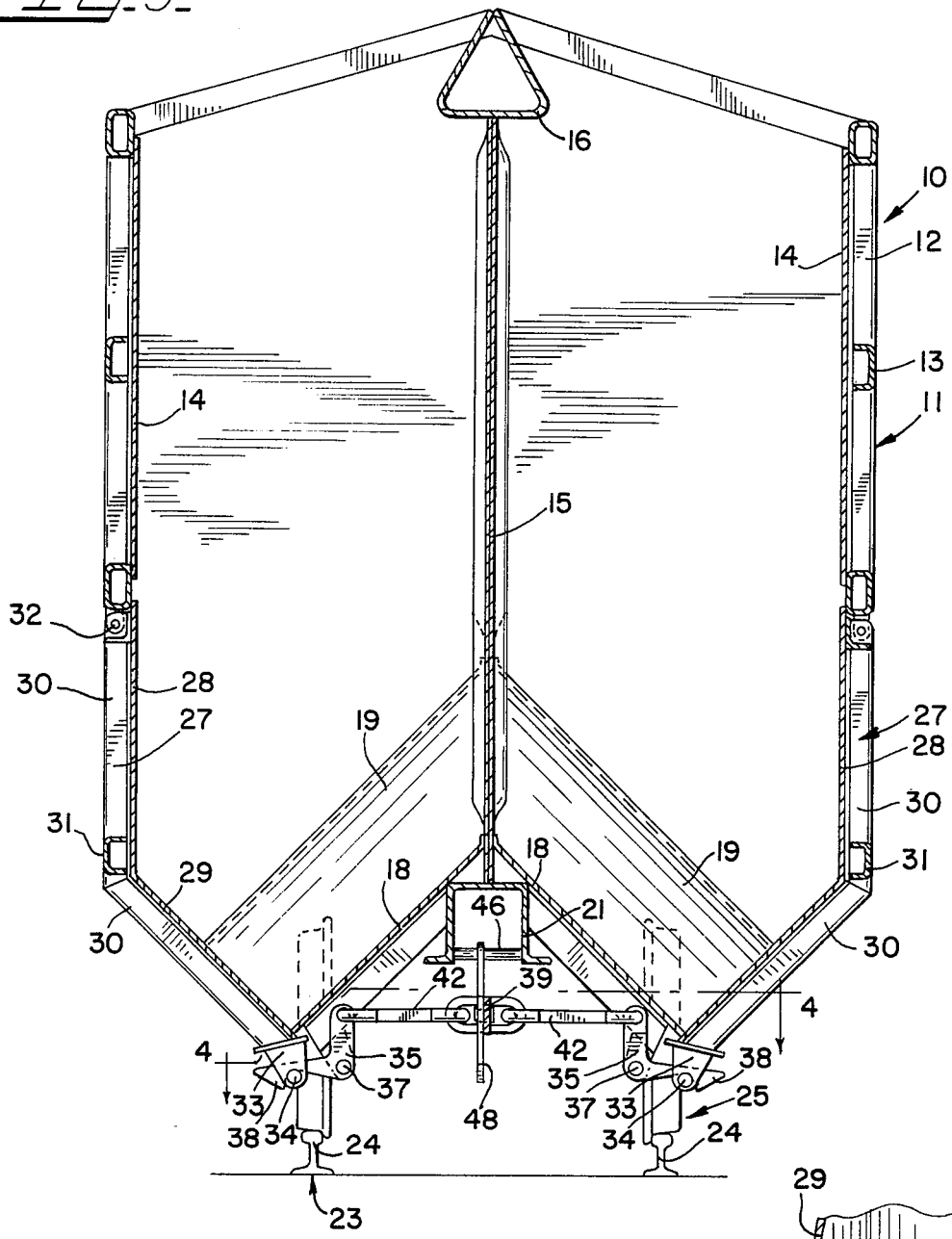
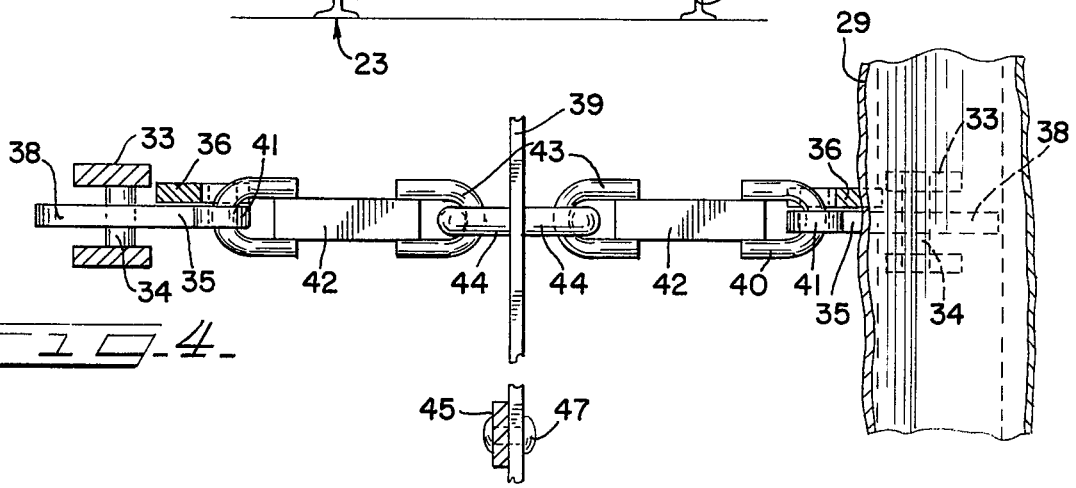
FIG. 4

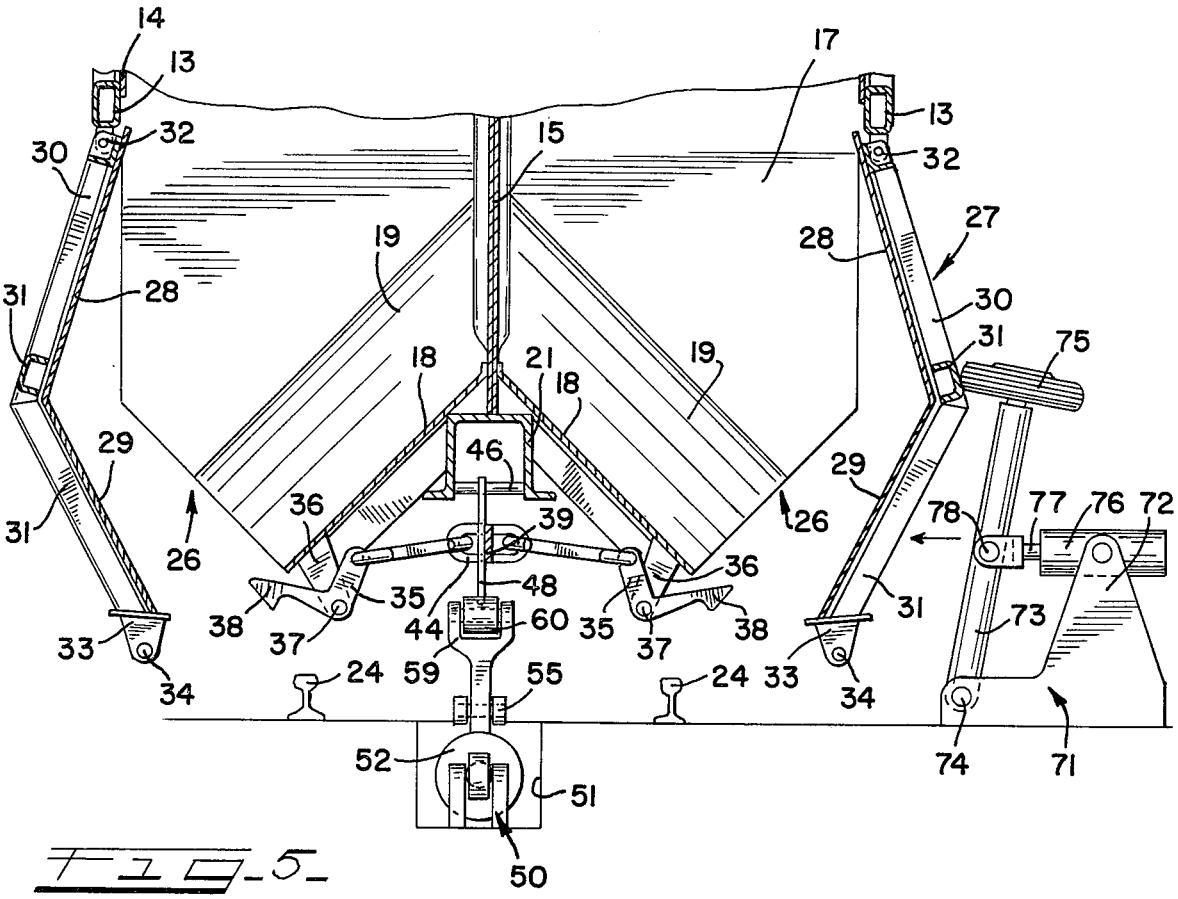
FIG. 5
FIG. 6
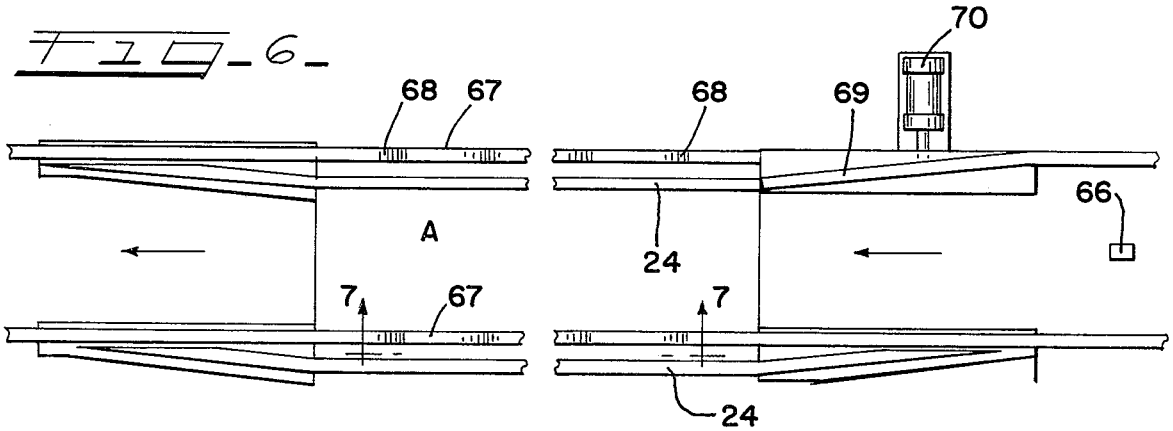
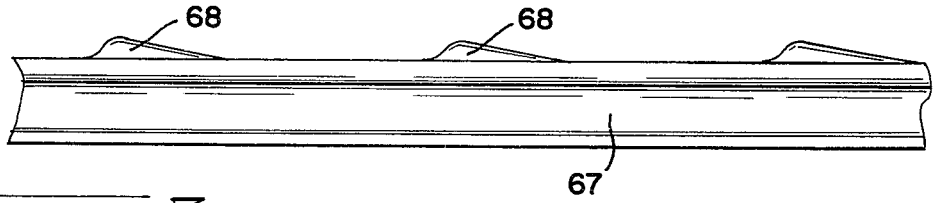
FIG. 7

DOOR LOCKING MECHANISM FOR SIDE DUMP RAILWAY HOPPER CARS

BACKGROUND OF THE INVENTION

1. Field of the Invention

The invention relates particularly to an open top hopper car and more specifically to a car which is readily adapted for carrying pulpwood products and the like and for discharging the same through lower side openings and discharge doors which are actuated by an improved ground mounted tripping mechanism.

2. Description of the Prior Art

Some of the pertinent patents of the prior art include locking devices for hopper cars which are shown in U.S. Pat. Nos. 1,225,522; 1,816,279; 2,400,026; 3,187,684 and 3,868,913. The present structure is an improvement over the patents of the prior art.

SUMMARY OF THE INVENTION

The railway car of the present invention includes an open top hopper having side discharge openings at its lower end. The side discharge openings are closed by means of outwardly swinging discharge doors. Cars of this type discharge their materials by gravity after the actuation of a mechanism which unlocks the doors. After the car has reached its destination and the material dumped therefrom, the car doors are again closed by an ontrack device which swings the doors inwardly. In the present design the railway car is provided with a central divider dividing the open top hopper car into two hopper type bin constructions. The swinging doors are arranged to pivot by gravity outwardly to an open position whereby the load may be discharged relatively outwardly and downwardly beneath the track structure as desired.

The improved door opening mechanism of the present invention includes a longitudinally extending actuating rod or member which is pivotally supported by the hat shaped center sill by means of hanger members which are suspended on transversely extending longitudinally spaced pivot bars provided within the center sill structure. The doors are firmly locked in a closed position by a plurality of longitudinally spaced locks which are connected to the longitudinal actuating rod or member. Each lock comprises latch brackets which are disposed on opposite sides of the center sill and project downwardly from the downwardly and outwardly extending slope sheets forming the lower portion of the car floor structure. Each of the brackets has connected thereto for pivotal rotation a bellcrank shaped member having at its outer ends a hook portion which in the lock position is adapted to engage a keeper provided on the lower edges of the door, the keepers being longitudinally spaced along the door to be engaged by longitudinally spaced lock mechanisms as described. In the closed position the hooks of the bellcrank shaped members are in locking engagement to firmly position and lock the doors in their closed position. In order to open the doors the actuating member is shifted longitudinally by means of a ground actuated tripping lever whereupon each of the bellcrank shaped levers are pivotally moved by means of flexible linkage mechanisms connecting the levers to the longitudinally movable actuating members.

The lever which longitudinally moves the actuating member is engaged by a fluid actuating or extensible device mounted between the tracks in a housing, the device being operable to engage and pivot the lever thereby providing for pivotal movement of the hook shaped latch elements out of engagement with the keeper members. The fluid actuating or extensible device is located adjacent to a suitable pit into which the material from the car is discharged directly beneath the tracks. After discharge of the material the car moves from the pit area on the track and is thereupon placed into position adjacent to door closing mechanisms which are actuated and which by means of fluid extensible devices provide an inward thrust on the said doors forcing them inwardly where they again engage the hook shaped members of the latches and again are locked in the closed position.

BRIEF DESCRIPTION OF THE DRAWINGS

FIG. 3 is a cross-sectional view taken substantially along the line 3—3 of FIG. 1;

FIG. 4 is a cross-sectional view of a door opening linkage mechanism taken substantially along the line 4—4 of FIG. 3;

FIG. 5 is an enlarged partial cross-sectional view similar to that shown in FIG. 3 disclosing an open position of the railway car doors;

FIG. 6 is a schematic view of a track arrangement in a pit area adapted to receive the load of a railway hopper car; and FIG. 7 is a side-elevational view taken substantially along the lines 7—7 of FIG. 6.

DESCRIPTION OF THE PREFERRED EMBODIMENT

Figure 1:
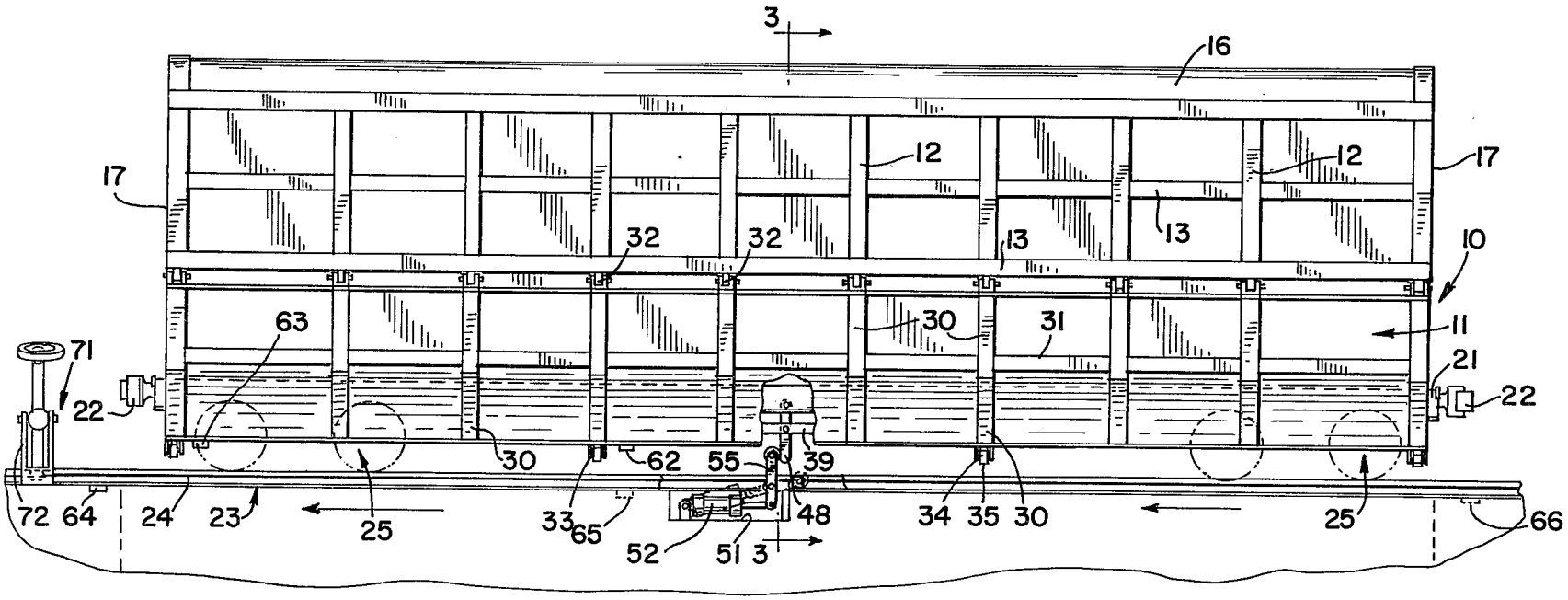
FIG. 1 is a side elevational view of an open top railway hopper car.
Figure 2:
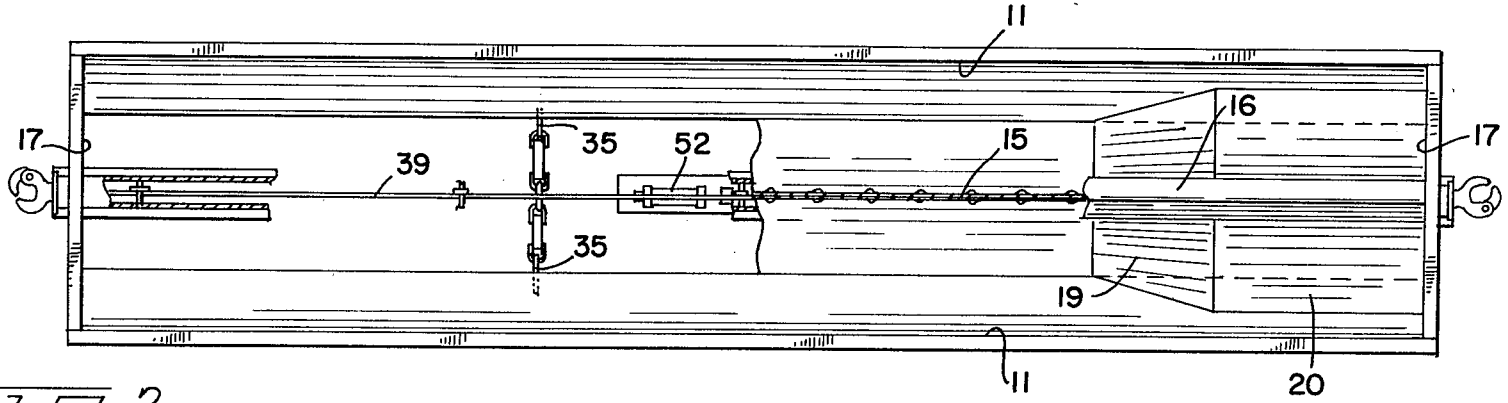
FIG. 2 is a plan view of the railway car disclosed in FIG. 1 with portions broken away to illustrate a door opening mechanism.

FIGS. 1 and 2 disclose the railway hopper car 10 of the open top type and includes car sides 11 formed by vertical outer posts 12 and horizontal posts 13 suitably connected together and including inner sheathing walls 14. The hopper car 10 is provided with a central longitudinal divider wall 15 forming a major beam structure of the car and which includes an upper longitudinal beam 16 suitably connected to end walls 17. The hopper car 10 is thus divided into laterally adjacent compartments and each includes a slope sheet 18 extending downwardly and outwardly with end sloping walls being designated at 19 at opposite ends of the car. The substantially flat end structure 20 is also positioned at opposite ends of the car.

The railway hopper car 10 includes a conventional hat shaped center sill 21 provided at opposite ends with car couplers 22. The car is supported on conventional track structure 23 including conventional standard rails 24. Wheel trucks 25 including suitable bolster structures [not shown] support the car at opposite ends thereof.

Figure 8:
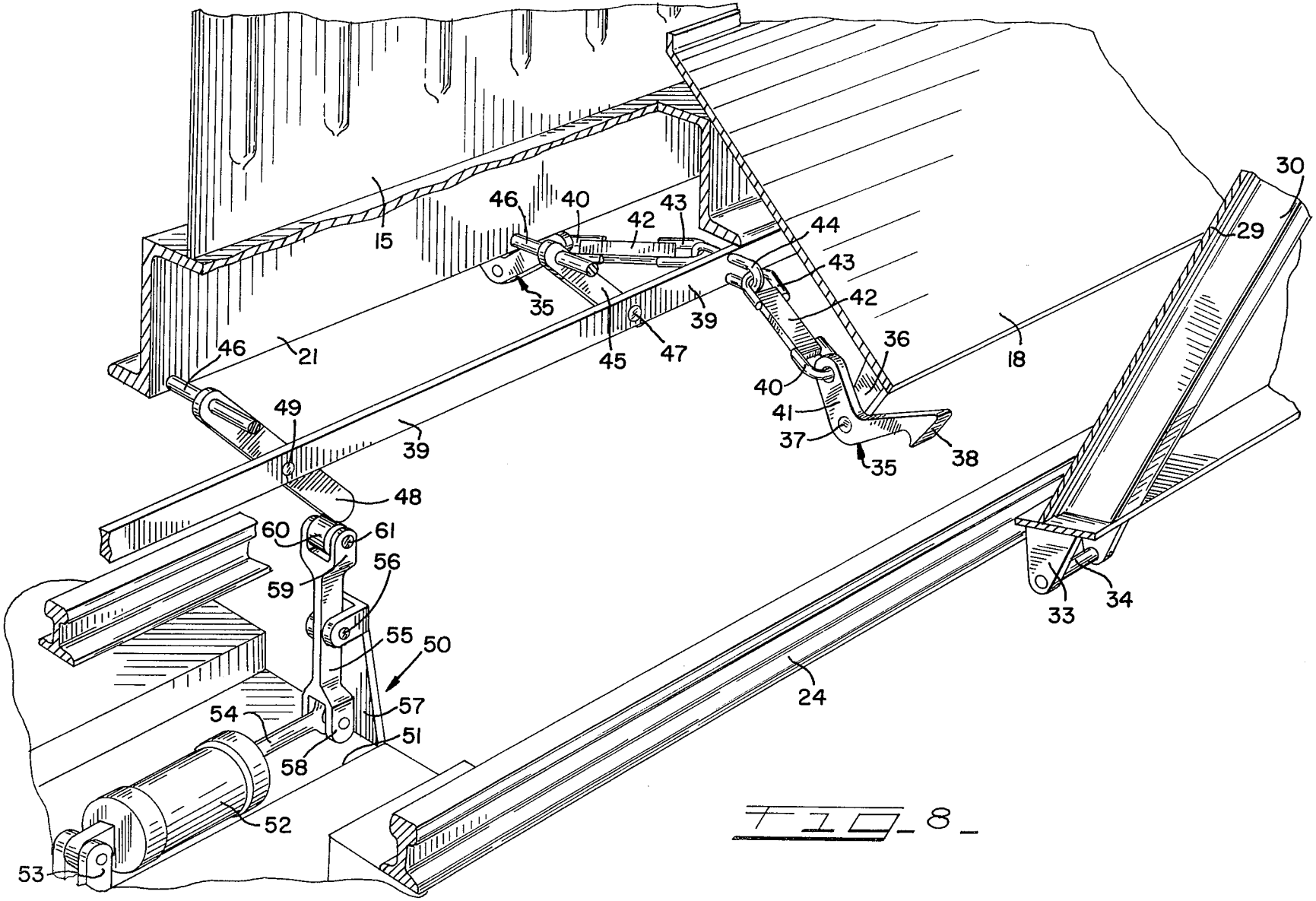
FIG. 8 is a fragmentation cutaway perspective view of the preferred embodiment.

As best shown in FIG. 8 the lower ends of the slope sheets 18 are substantially spaced inwardly and provide suitable discharge openings 26 extending substantially the length of the car. Doors generally designated at 27 are provided at opposite sides of the car for closing the discharge openings 26. Each of the doors 27 includes an upper panel 28 and a lower panel 29 suitably connected together. The panels are reinforced by vertical beams 30 in turn connected to horizontally extending beams 31. Hinge brackets 32 provided at the upper ends of the doors 27 are hingedly connected to lower horizontal members 13 whereby the doors may be hingedly swung outwardly and inwardly as desired. The lower ends of the doors 27 are provided with keeper brackets 33, each of which includes a longitudinally extending keeper pin 34. The door opening mechanism includes a latch element 35 formed in the manner of a bell crank which is pivotally mounted to brackets 36 projecting downwardly from the slope sheets 18 by means of longitudinal pivot members 37. Each of the latch elements 35 is provided with a hook shaped end 38 which is adapted to engage the pin 34 of the keeper bracket 33, as best shown in FIG. 3 to maintain the doors 27 in a locked condition.

The latch elements 35 are actuated by means of a longitudinally extending actuating bar or member 39 which is supported for longitudinal movement on the center sill 21 by means of hangers or links 45. As best shown in FIG. 8 the bell crank lever 35 includes an arm portion 41 which in turn is connected to a link 40 in turn rigidly connected to a strap member 42. The link 40 is adapted to pivot relative to the arm 41 as indicated. The other end of the strap 42 includes a link 43 which is in pivotal and hooked relation with respect to another link 44 in turn rigidly connected to the longitudinal actuating member 39. This type of flexible linkage arrangement thus is positioned on opposite sides of the longitudinal actuating member and in turn each one of these is connected to the bell shaped latching member with the hook shaped end so that along longitudinally spaced points of the car this arrangement is provided to effectively lock the elongated doors in the closed position.

The hangers or links 45 as best shown in FIG. 8 are pivotally supported on pivot rods 46 longitudinally spaced along the center sill of the car. The hangers 45 are pivotally connected to the longitudinal actuating member 39 by pivot means 47 as indicated. As best indicated in FIGS. 1 and 8 substantially centrally of the pit area there is provided between the track structure 23 a door actuating mechanism 50 which is supported in a recessed concrete structure 51 recessed within the ground between the tracks. The door actuating mechanism includes a fluid actuated cylinder 52 suitably pivotally supported on an anchor bracked 53 in turn rigidly supported within the recessed concrete structure 51. The piston rod 54 projects and reciprocates outwardly of the cylinder 52 and is connected to a lever 55 pivotally connected as indicated at 56 to a bracket 57 also supported on the structure 51. The lever 55 is provided at its lower end with a clevis 58 to which the piston rod 54 is pivotally connected. The upper end of the lever 55 also includes a clevis 59 which in turn supports a roller 60 on a suitable journal 61. As shown in FIG. 8 the roller 60 is adapted to engage the arm 48 for pivoting the same about its pivot 49 to thereby move the longitudinal actuating member 39 in a longitudinal direction which as shown in FIG. 8 pivots the bell crank latches 35 to their unlocked position.

As best shown in FIG. 1 magnets 62 and 63 are secured to the underneath portion of the railway hopper car 10 in a suitable manner and position. Switches 64, 65 and 66 are positioned adjacent to the railway track structure 23 as also disclosed in FIG. 1.

Referring now particularly to FIGS. 6 and 7 portions of the track structure 24 are disclosed in schematic manner. In addition special rails 67 are provided which at their left hand end merge into the track rails 24 which are of course the standard rail structure. The special rails 67, as best shown in FIG. 7 are provided with longitudinally spaced bumps or raised portions 68 suitably provided on the upper flanged surface of each of the special rail 67. As shown in FIG. 6 the rails 24 and 67 span a pit area designated at A which provide a dump opening whereby materials within the car are dumped into a suitable pit beneath the rails as is customary in railroad operations where the side or bottom dump discharge systems are utilized. FIG. 6 also discloses the switch 66 and further includes a switch track rail portion 69 which is movable into registry with either one of the standard rails 24 or into registry with one of the special adjacent rails 67 for thus switching the rail cars into the position desired. The switching rail 69 is actuated to be pivotally moved by means of a fluid actuated device 70 which is actuated in response to actuation of the switch 66 as will be further described below.

Referring now particularly to FIGS. 1 and 5 the door closing mechanism is indicated at 71 and includes a ground mounted housing 72 to which is pivotally connected an arm 73 at a pivot 74. The upper end of the vertical arm has provided thereon a rubber tired wheel 75 which rotates about a vertical axis. A fluid actuated device 76 includes a piston arm 77 which is pivotally connected at 78 to the vertical arm 73 which upon switch actuation moves in the direction of the arrow against the door for moving the same to a closed position. One of these devices is provided on each side of the track and functions as a railroad car passes through that portion of track on which these devices are situated.

OPERATION

The position of the hopper car doors is shown in FIG. 3. Referring now to FIG. 1 and assuming that the car is moving from the right hand to the left as indicated in the arrow it approaches the switch 66. The switch 66 may be of suitable type being magnetically controlled by the magnets which are mounted on the car. As the magnet 63 on the car moves over the switch 66 the switch track 69 by operation of the extensible device 70 is moved into registry with the special rail 67 so that the string of cars following will ride and thus guides on the special rails 67. The wheels ride over the bumps 68 and the effect is to jar loose the material which is within the car, said jarring action assisting the natural gravity flow from the car outwardly through the discharge doors when the doors are opened. The magnet 62 now moves over the switch 65 whereupon the switch 65 activates the fluid actuated cylinder 52 in turn causing the piston 54 to withdraw so as to move the arm 55 and roller 60 into engagement with the actuating arm 48 to move the same about the pivot 46 in turn moving the longitudinal actuating arm in a longitudinal direction whereupon the strap 42 and associated linkage arrangement causes counterclockwise pivotal movement of the hook 38 of the bell crank lever 35 of each of the closure devices and moves them to the position shown in FIGS. 5 and 8. Since the hooks 38 are now removed from the keeper pins 34 the doors will open by gravity and because of the gravity pressure from the load contained therein they are moved to the position shown in FIG. 5 and the load dumped. Thereafter, continued movement of the magnets with the train now causes the fluid actuated cylinder 52 to return to the dotted line position shown in FIG. 1 and as the magnet which relates to the switch 64 passes in proximity thereto the door closing mechanism 71 on opposite sides of the car move the rubber tired wheel 75 in engagement and inwardly with respect to the doors, again returning them to the closed position. The longitudinal actuating rod 39 and arm 48 are again moved to their normal closed position and the doors are engaged in a securely locked position by the hook shape portions 38 of the bell crank levers.

If the individual cars are shunted to the pit area, each car is capable of discharging its load and moving to the jarring track as desired. If the cars in a train are being pulled by the locomotive it is a simple matter for the locomotive to ride over the standard track as the switching is arranged in FIG. 6 whereafter the magnets can be energized to then switch the cars to the special track to secure the benefit of the jarring or breaking loose condition effectuated by the bumps on the surface of the track.

Thus it is clear that an improved railway hopper car unloading arrangement and positive locking device for the discharge doors have been disclosed which provide for more positive and immediate discharge of material and guarantee the positive closure of the doors during transit.

What is claimed is:

1. For a railway hopper car having a hopper including a downward and outward extending slope sheet structure terminating adjacent to a side discharge opening, and, a door hingedly connected to said car for swinging movement between open and closed positions relative to said opening, the improvement of a locking arrangement comprising, a latch support connected to said hopper adjacent to said discharge opening, a latch element pivotally connected to said support for pivotal movement about an axis extending generally longitudinally of said car, a keeper member on said door, a longitudinally extending actuating member supported on said hopper car for longitudinal movement below said slope sheet structure, means for moving said actuating member longitudinally, flexible connecting means connected to said actuating member and said latch element, and said latch element, in a locked position with respect to said keeper member being pivotally movable during movement of said actuating member to an unlatched position whereupon said door is moved by gravity to an open position.

2. The invention in accordance with claim 1, said keeper member on said door including a longitudinal catch, and said latch element comprising a bell crank shaped member having a hook end engageable with said catch to lock said door.

3. The invention in accordance with claim 1, said flexible connecting means including chain type links.

4. For a railway hopper car having a hopper including a downwardly and outwardly extending slope sheet structure terminating adjacent to a side discharge opening and, a door hingedly connected to said car for swinging movement between open and closed positions relative to said opening, the improvement of a locking arrangement comprising, a latch support connected to said hopper adjacent to said discharge opening, a latch element pivotally connected to said support, a keeper member on said door, a longitudinally extending actuating member supported on said car for longitudinal movement below said slope sheet structure, means for moving said actuating member longitudinally, flexible connecting means connected to said actuating member and said latch, said flexible connecting means including a strap, first and second links on said strap, said first link being pivotally connected to said latch element, a third link on said actuating member, said second link being pivotally connected to said third link, and said latch element in a locked position with respect to the keeper member being pivotally movable during movement of the said actuating member to an unlatched position whereupon said door is moved by gravity to an open position.

5. For a railway hopper car having a hopper including a downwardly and outwardly extending slope sheet structure terminating adjacent to a side discharge opening, and a door hingedly connected to said car for swinging movement between open and closed positions relative to said opening, the movement of a locking arrangement comprising, a latch support connected to said hopper adjacent to said discharge opening, a latch element pivotally connected to said support, a keeper member on said door, a longitudinally extending actuating member supported on said car for longitudinal movement below said slope sheet structure, said car including a center sill supported beneath said hopper structure, means for supporting said actuating member on said sill including arms hingedly connected to said sill and pivotally connected to said actuating member, means for moving said actuating member longitudinally, flexible connecting means connected to said actuating member and said latch element, and said latch element in a locked position with respect to said keeper member being pivotally movable during movement of said actuating member to an unlatched position whereupon the door is moved by gravity to an open position.

6. The invention in accordance with claim 5, and railway track supporting said car, power actuated tripping means adjacent to said track, a trip lever connected to said actuating member, and means on said tripping means engaging said trip lever to move said actuating member longitudinally thereby unlocking said door.

7. The invention in accordance with claim 6, and a track side closure mechanism selectively operable to engage and move said doors inwardly to a closed position.

8. For a railway hopper car having a hopper including a downwardly and outwardly extending slope sheet structure terminating adjacent to a pair of discharge openings, a center sill supporting said hopper, a railway track structure, wheel structure supporting said car on said track structure and hinged doors connected to said car for lateral swinging movement between open and closed position relative to said discharge openings, the improvement of a locking arrangement comprising;

latch elements pivotally connected to said slope sheets, keeper means on said doors engageable by said latch elements for locking and unlocking said doors, a longitudinally extending actuating member movably connected to said center sill for longitudinal movement, ground supported means positioned adjacent said track for longitudinally moving said actuating member, and flexible connecting means connecting said latch elements to said actuating member for moving said latch elements to an open position relative to said keeper means.

9. The invention in accordance with claim 8, and said flexible connecting means including a pair of straps on opposite sides of said longitudinal actuating member, first and second links on each strap, said first links being pivotally connected to said latch elements, third links on said actuating member, and said second links being pivotally connected to said third links.

10. The invention in accordance with claim 8, and said latch elements including hook shaped ends and having a relatively bell crank shaped configuration.

11. The invention in accordance with claim 8, and said railway track structure including a pair of standard rails supported over an opening comprising a dumping pit into which material from said hopper car is discharged between said track structure, said track structure including a pair of special rails extending over said dumping pit parallel to said first rails and leading into registry with said first rails at one side of said dumping pit, and switching rail means on the other side of said dumping pit movable alternately into registry with said standard and special rails, said special rails having portions thereon for causing jarring movement of said car to facilitate discharge of the cargo through said discharge openings into said dumping pit.

12. The invention in accordance with claim 11, and said jarring portions comprising raised portions longitudinally spaced on the top portions of said rails.

13. In a railway car having a hopper including a bottom discharge opening, a door hingedly mounted on said car for swinging movement between closed and opened positions with respect to said opening, a latch support mounted on the car, a latch element pivotally carried on said support, a keeper on said door positioned for engagement with said latch element in the closed position of the door, an elongated actuator supported on said car for generally longitudinal movement of the car and in a plane transverse to the plane of movement of the latch element, and means for moving said actuator, and means operatively connecting said actuator with said latch element for translating the longitudinal movement of said actuator to said pivotal movement of said latch element for unlatching the same from said keeper whereupon the door swings to an open position.

14. The invention in accordance with claim 13, wherein said means for operatively connecting said actuator with said latch element comprising articulated interconnected links.

* * * * *